US009405227B2

(12) United States Patent
Mizusawa et al.

(10) Patent No.: US 9,405,227 B2
(45) Date of Patent: Aug. 2, 2016

(54) POWDER CONVEYING DEVICE, PROCESS CARTRIDGE, AND IMAGE FORMING APPARATUS

(71) Applicants: Hiroshi Mizusawa, Tokyo (JP); Kuniyori Takano, Kanagawa (JP); Takuya Sekine, Kanagawa (JP); Kohsuke Yamamoto, Kanagawa (JP)

(72) Inventors: Hiroshi Mizusawa, Tokyo (JP); Kuniyori Takano, Kanagawa (JP); Takuya Sekine, Kanagawa (JP); Kohsuke Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/703,242

(22) Filed: May 4, 2015

(65) Prior Publication Data

US 2015/0346638 A1 Dec. 3, 2015

(30) Foreign Application Priority Data

May 27, 2014 (JP) ..... 2014-109254

(51) Int. Cl.
*G03G 21/00* (2006.01)
*G03G 15/08* (2006.01)
*G03G 21/10* (2006.01)

(52) U.S. Cl.
CPC ..... *G03G 15/0891* (2013.01); *G03G 15/0879* (2013.01); *G03G 21/105* (2013.01)

(58) Field of Classification Search
CPC ..... G03G 15/0879; G03G 21/105
USPC ..... 399/358
See application file for complete search history.

(56) References Cited

U.S. PATENT DOCUMENTS 4,197,230 A * 4/1980 Baney ..... C08J 7/047 428/412
2005/0019057 A1 1/2005 Mizusawa
2008/0260431 A1 10/2008 Saito
2009/0257799 A1 10/2009 Haruno et al.
2010/0239340 A1* 9/2010 Akaike ..... G03G 21/105 399/358
2011/0064452 A1 3/2011 Mizusawa
2011/0206433 A1* 8/2011 Gayne ..... G03G 21/12 399/358
2013/0163998 A1 6/2013 Mizusawa
2014/0037322 A1* 2/2014 Sato ..... G03G 21/105 399/101
2015/0277293 A1* 10/2015 Maehara ..... G03G 15/0891 399/258

FOREIGN PATENT DOCUMENTS

JP 2005-070260 3/2005
JP 2008-268445 11/2008
JP 2013-225050 10/2013

* cited by examiner

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

A powder conveying device, including: a powder conveying path including a curved portion; and a conveying screw, wherein the conveying screw is disposed in the powder conveying path, and includes: a rotation axis portion having flexibility; and a blade portion, where the blade portion is helically formed on an outer periphery of the rotation axis portion, and is configured to convey a powder, wherein the conveying screw includes a conveying screw curved portion located in the curved portion of the powder conveying path, and wherein at least a surface of the blade portion of the conveying screw curved portion includes a slipping layer containing a silicon-containing compound.

20 Claims, 4 Drawing Sheets

POWDER CONVEYING DEVICE, PROCESS CARTRIDGE, AND IMAGE FORMING APPARATUS

BACKGROUND OF THE INVENTION

1. Field of the Invention

The present invention relates to a powder conveying device, a process cartridge including the powder conveying device, and an image forming apparatus.

2. Description of the Related Art

In recent years, demand has arisen for miniaturizing image forming apparatuses such as a printer, a copying machine, a facsimile machine. As a result of miniaturizing the image forming apparatuses, a powder conveying path having a tubular body cannot be linearly disposed in the powder conveying device while avoiding other members therein, where the powder conveying path serves as a path conveying a toner from a toner accommodating container to a developing device therein; and a path conveying a waste toner collected from a cleaning unit to a waste toner-accommodating container therein. Thus, it is disposed so as to be curved therein, and a generally usable powder conveying device is a powder conveying device configured to dispose a conveying screw capable of being curved in the inner part of the tubular body.

The conveying screw includes a rotation axis portion and a blade portion, where the blade portion is helically formed on an outer periphery of the rotation axis portion. The conveying screw is disposed in the powder conveying path having a curved portion, and thus the toner and the waste toner can be conveyed even in the curved powder conveying path.

For example, as shown in Japanese Patent Application Laid-Open (JP-A) No. 2008-268445, proposed is a low-cost powder conveying device, where the powder conveying device include a resin material capable of curving and having flexibility as a material of the conveying screw; and is formed by integrating a rotation axis portion with a blade portion.

However, in cases where the conveying screw is used, the below-described problems may be caused.

In the curved powder conveying path, the conveying screw containing the resin material is left to stand for a long time in a state that it is not operated, and thus peculiarity following a shape of the curved powder conveying path occurs in the conveying screw, as property of the resin materials.

In particular, in cases where the conveying screw is left to stand in an environment of high temperature, a degree of this peculiarity comes more significantly. In this state, the conveying screw is rotated by transferring driving power, and thus a portion having a peculiarity temporarily causes rotary malfunction in the powder conveying path. As a result, when rotary torque of the conveying screw is fluctuated and the conveying screw is rotated, collision with an inner wall of the powder conveying path occurs in a portion having a peculiarity.

Thus, an extraordinary noise is caused by colliding the conveying screw with the inner wall of the powder conveying path, which is problematic when users have received the products. It is believed that the louder the noise generated during driving is, the more severely the conveying screw collides with the inner wall of the powder conveying path. In cases where a driving part of the conveying screw is connected with a row of photoconductor drives, banding is caused because the rotary torque is fluctuated and the vibration is caused by colliding the conveying screw with the inner wall of the powder conveying path, which is a factor in forming an abnormal image.

SUMMARY OF THE INVENTION

An object of the present invention is to provide a powder conveying device including a conveying screw, in which rotation of the conveying screw is not inhibited and rotary malfunction can be prevented in the powder conveying path when the powder conveying device having the conveying screw with a peculiarity is driven.

As means for solving the above problems, a powder conveying device of the present invention includes: a powder conveying path including a curved portion; and a conveying screw, wherein the conveying screw is disposed in the powder conveying path, and includes: a rotation axis portion having flexibility; and a blade portion, where the blade portion is helically formed on an outer periphery of the rotation axis portion, and is configured to convey the powder, wherein the conveying screw includes a conveying screw curved portion located in the curved portion of the powder conveying path, and wherein at least a surface of the blade portion of the conveying screw curved portion includes a slipping layer containing a silicon-containing compound.

According to the present invention, a powder conveying device including a conveying screw, in which rotation of the conveying screw is not inhibited and rotary malfunction can be prevented in the powder conveying path when the powder conveying device having the conveying screw with a peculiarity is driven, can be provided.

Figure 1:
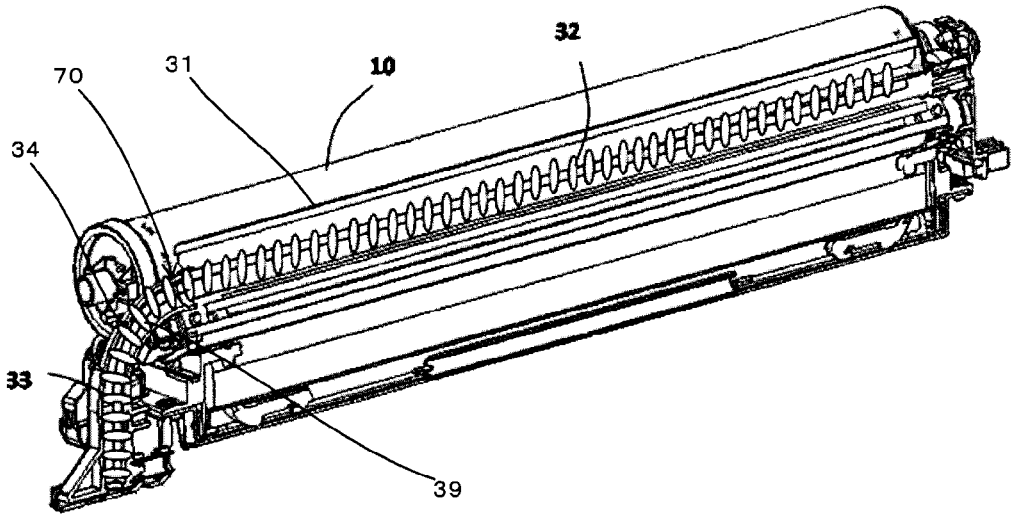
FIG. 1 is a schematic perspective view of one example of a powder conveying device of the present invention.

DETAILED DESCRIPTION OF THE INVENTION (Powder Conveying Device)

A powder conveying device of the present invention includes a powder conveying path and a conveying screw in order to convey a powder, further includes other members.

<Powder Conveying Path>

The powder conveying path includes a curved portion. A shape, a thickness, and a material thereof is not particularly limited and may be appropriately selected depending on the intended purpose.

The shape of the powder conveying path is not particularly limited and may be appropriately selected depending on the intended purpose. The shape is preferably a tubular body so that the conveying screw conveying the powder can be disposed in the powder conveying path. Examples of the shape include a cylindrical body, an elliptically cylindrical body, a triangularly cylindrical body, and a square cylindrical body. Among them, a cylindrical body having no corner is preferable because the conveying screw is configured to smoothly convey the powder while being driven to rotate in the powder conveying path.

The thickness of the powder conveying path is not particularly limited and may be appropriately selected depending on the intended purpose.

The material of the powder conveying path is not particularly limited and may be appropriately selected depending on the intended purpose. When the powder conveying path is incorporated in an image forming apparatus described hereinafter, it is disposed so as to be curved in order to avoid other materials. Thus, the powder conveying path preferably includes a material having flexibility, and the material is preferably a resin or a metal. As the material, a resin is suitably used because it has flexibility and is easy to form the powder conveying path. Examples of the resin include polyethylene, ABS, FRP, and TEFLON (registered trademark). In order not to inhibit rotation of the conveying screw, a suitably usable powder conveying path is a powder conveying path having an inner wall coated or formed by a material having low coefficient of friction, or a powder conveying path formed by using a resin which contains a material having low coefficient of friction. Examples of the metal include chromium-nickel alloy, titanium alloy, stainless steel, aluminum, and iron.

The powder conveying path preferably includes a powder receiving portion.

The powder receiving portion is disposed at one end of the powder conveying path, and is configured to receive the powder transferred from another place, and then the powder is collected therein. A shape and a material thereof are not particularly limited and may be appropriately selected depending on the intended purpose.

The shape of the powder receiving portion is not particularly limited and may be appropriately selected depending on the intended purpose. As the powder conveying device configured to convey a residual toner serving as the powder, which adheres to a photoconductor described hereinafter, the powder conveying device preferably has such a shape so that dispersion of the residual toner is prevented, when the photoconductor is cleaned in a cleaning unit described hereinafter. For example, the powder receiving portion is parallel to a longitudinal direction of the photoconductor and is the same length with the longitudinal direction thereof. A cross-sectional shape of the powder receiving portion is, for example, a generally flat plate shape including a curved bottom portion. The curved bottom portion is obtained so as to have an arc having substantially the same diameter with an outer diameter of the blade portion of the conveying screw, and thus the conveying screw is disposed at the bottom portion, to thereby convey the residual toner piled on the bottom portion into the powder conveying path by the conveying screw.

The material of the powder receiving portion is not particularly limited and may be appropriately selected depending on the intended purpose.

<Conveying Screw>

The conveying screw is disposed in the powder conveying path, and includes a rotation axis portion and a blade portion containing a slipping layer on at least part thereof, and further includes other members, if necessary. The powder conveying path includes the curved portion, and thus the conveying screw includes a conveying screw curved portion.

—Rotation Axis Portion—

A shape, a length, and a material of the rotation axis portion are not particularly limited and may be appropriately selected depending on the intended purpose. The blade portion is helically formed on an outer periphery of the rotation axis portion.

The shape of the rotation axis portion is not particularly limited and may be appropriately selected depending on the intended purpose. A columnar or cylindrical, a rhabdite or a tubular body is preferable because the blade portion is helically formed on the outer periphery of the rotation axis portion in the powder conveying path.

The length of the rotation axis portion is not particularly limited and may be appropriately selected depending on the intended purpose. The rotation axis portion preferably has such a length as to be able to convey the powder to a prescribed place via the powder conveying path.

The material of the rotation axis portion is not particularly limited and may be appropriately selected depending on the intended purpose. It is preferably a material having flexibility, more preferably a material containing a resin, still more preferably an elastomer resin, because the rotation axis portion is disposed in the powder conveying path, which is curved and disposed in an inner part of another device.

—Blade Portion—

A shape, a size, an interval (pitch), and a material the blade portion are not particularly limited and may be appropriately selected depending on the intended purpose, so long as the blade portion is configured to wind around the rotation axis portion.

The shape of the blade portion is not particularly limited and may be appropriately selected depending on the intended purpose. As mentioned above, the blade portion is helically formed on an outer periphery of the rotation axis portion, and is disposed together with the rotation axis portion in the powder conveying path. Thus, preferably, a cross-sectional shape perpendicular to the blade portion is substantially the same shape with a cross-sectional shape perpendicular to the powder conveying path. In other words, when the powder conveying path is a cylindrical body, the outer peripheral shape of the blade portion is preferably generally circular shape.

The size of the blade portion is not particularly limited and may be appropriately selected depending on the intended purpose. Preferably, an outer diameter of the blade portion is substantially the same with an internal diameter of the powder conveying path because it is disposed in the powder conveying path and is configured to convey the powder.

The interval (pitch) P of the blade portion is not particularly limited and may be appropriately selected depending on the intended purpose.

The material of the blade portion is not particularly limited and may be appropriately selected depending on the intended purpose. It is preferably a material having flexibility, more preferably a resin, still more preferably an elastomer resin, because the blade portion is disposed together with the rotation axis portion in the powder conveying path including a curved portion. In addition, the rotation axis portion may be integrally formed with the blade portion.

—Slipping Layer—

The slipping layer is formed on portion of at least the blade portion. An average thickness, a material, and a forming method thereof are not particularly limited and may be appropriately selected depending on the intended purpose.

The slipping layer may be formed on the blade portion in the conveying screw curved portion of the conveying screw, which is located in the curved portion of the powder conveying path. Alternatively, the slipping layer may be formed on the entire conveying screw including the entire blade portion and the rotation axis portion.

An average thickness of the slipping layer is not particularly limited and may be appropriately selected depending on the intended purpose. The average thickness of the slipping layer is preferably 2 μm to 30 μm, considering that the blade portion and the rotation axis portion in which the slipping layer is formed can smoothly be rotated in the powder conveying path; and considering durability in an abutment part between the inner wall of the powder conveying path and the blade portion. The average thickness of the slipping layer is 2 μm or more, and thus a sufficient effect in durability can be obtained by the slipping layer. The average thickness of the slipping layer is 30 μm or less, and thus bendability of the conveying screw can be maintained; and a curvature and a rotating operation of the conveying screw can be more efficiently performed in the powder conveying path due to the above average thickness.

The slipping layer includes a silicon-containing compound as the material thereof. Examples of the silicon-containing compound include a siloxane compound and a silazane compound including any one of Si, Si—O, Si—N, and Si-Me, which can form the slipping layer at low temperature (room temperature) so that the conveying screw is not deformed with heat during forming the slipping layer. In detail, examples thereof include a siloxane-based polymer, a polysiloxane-based polymer, a silazane-based polymer, and a polysilazane-based polymer.

The siloxane compound is a compound containing silicon and oxygen serving as a skeletal structure, and is a general term of a compound including a Si—O—Si bond (siloxane bond). Its general formula is represented by $R_3SiO—(R_2SiO)_n—SiR_3$.

The silazane compound is a compound having a silicon-nitrogen bond in a molecular, and its general formula is represented by $R_3SiNH—(R_2SiNH)_n—SiR_3$.

As the material of the slipping layer, a fluorine-containing compound can be used instead of the silicon-containing compound. Examples of the fluorine-containing compound include PFA (tetrafluoroethylene-perfluoroalkyl vinylether copolymer), PTFE (polytetrafluoroethylene), and FEP (tetrafluoroethylene-hexafluoropropylene copolymer).

A method for forming the slipping layer is not particularly limited and may be appropriately selected depending on the intended purpose. Examples thereof include a dipping method, a roller coating method, a spray coating method, and a spin coating method.

In the present embodiment, the slipping layer is formed by the dipping method. The detailed method for forming the slipping layer is as follows.

First, a clipping solution which contains a silicon-containing compound is prepared.

Then, a portion of the conveying screw to be provided with a slipping layer, is dipped in the dipping solution, is pulled up from the solution, and then is subjected to air seasoning.

As a result, the slipping layer is formed on the surface of the conveying screw.

<Powder>

The powder is not particularly limited and may be appropriately selected depending on the intended purpose. Examples thereof include an inorganic powder, an organic powder, a powder of metallic soap, a colored pigment, a pearl pigment, a metal powder, a tar dye, a natural pigment, and a toner. As a shape and a structure of the powder, any powder can be used without distinction of particle shapes (e.g., a spherical shape, a needle shape, and a tabular shape), particle diameters (e.g., a fumed shape, a fine particle, and a pigment-grade shape), and structures of particles (e.g., porous structure and nonporous structure). Among them, a toner is preferable. Examples thereof include a used toner and an unused toner. A powder conveying device of the present invention can be used for conveying a toner.

<Other Members>

The aforementioned other members are not particularly limited and may be appropriately selected depending on the intended purpose. Examples thereof include a gear.

A shape and a material of the gear are not particularly limited and may be appropriately selected depending on the intended purpose. For example, in order to drive the conveying screw to rotate, the gear is provided with one end of the rotation axis portion of the conveying screw, and driving power, which is come from a driving source provided with the external device, is transferred via the gear.

The shape of the gear is not particularly limited and may be appropriately selected depending on the intended purpose.

The material of the gear is not particularly limited and may be appropriately selected depending on the intended purpose.

As the gear, gears of a commercially available products can be used.

Figure 2A:
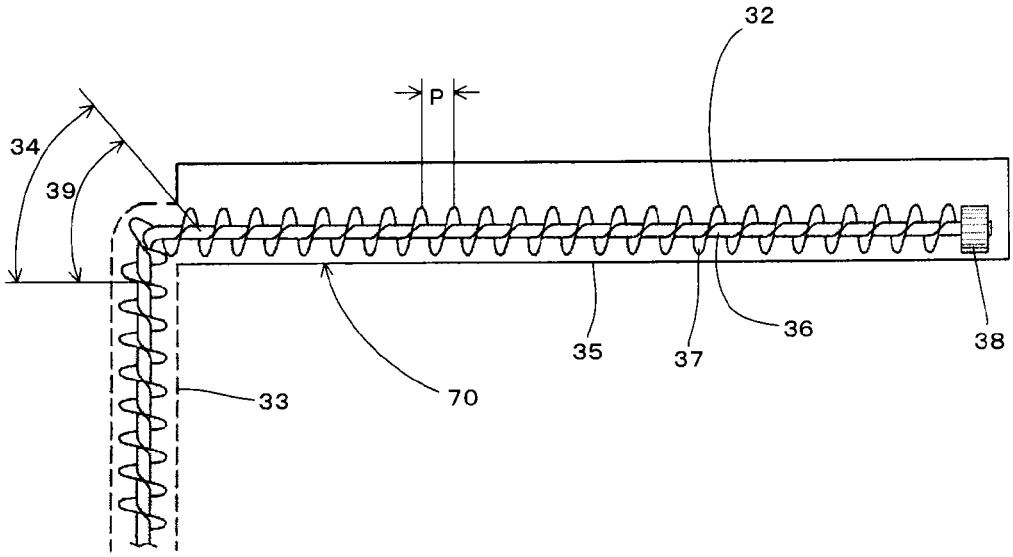
FIG. 2A is a schematic elevation view of one example of a powder conveying device of the present invention.
Figure 2B:
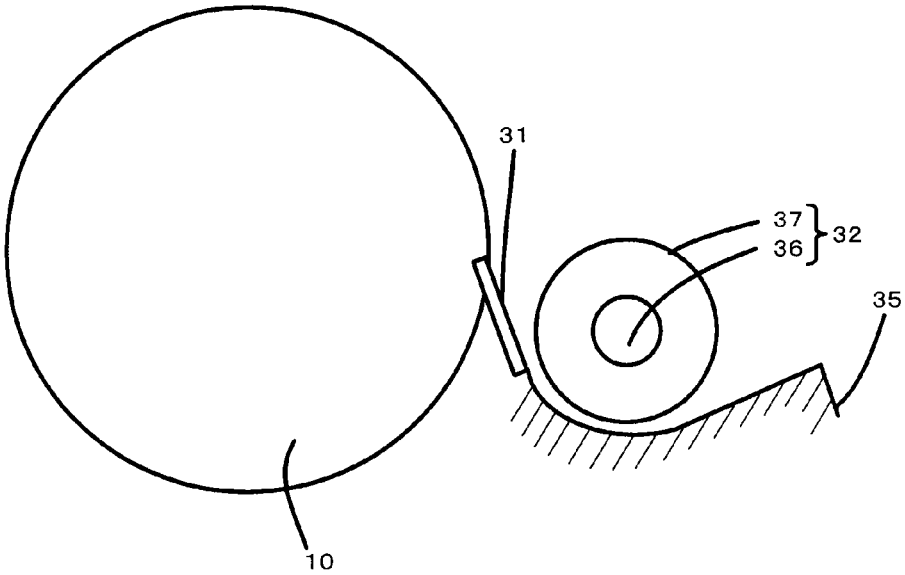
FIG. 2B is a schematic, left-hand side, cross-sectional view of one example of a powder conveying device of the present invention.

Next, a powder conveying device of the present invention will be described in detail with reference to FIGS. 1, 2A, and 2B. FIG. 1 is a schematic perspective view of one example of a powder conveying device of the present invention. FIG. 2A is a schematic elevation view of one example of a powder conveying device of the present invention. FIG. 2B is a schematic, left-hand side, cross-sectional view of one example of a powder conveying device of the present invention. In the present embodiment, an example where a toner is used as a toner will be described hereinafter.

Note that, a powder conveying device of the present embodiment is configured to clean a residual toner deposited on a photoconductor by a cleaning unit, and then the cleaned residual toner is conveyed to a prescribed place.

As shown in FIG. 1, a powder conveying device 70 of the present invention includes a powder conveying path 33 and a conveying screw 32. The powder conveying device 70 shown in FIG. 1 is configured to drop the collected toner in a vertical manner by vertically converting a conveying direction thereof, and to convey the toner to a prescribed place by the powder conveying path 33.

As shown in FIGS. 1, 2A, and 2B, the powder conveying path 33 includes at least one curved portion 34, and is configured to convey a toner to a desired place, such as a tank accommodating a used toner, and a place supplying the toner.

Also, a powder conveying path 33 of the present embodiment includes a powder receiving portion 35 at one end thereof. The powder receiving portion 35 is configured to receive a residual toner remaining on a photoconductor 10, when the surface of the photoconductor 10 is cleaned by a cleaning blade 31. As shown in FIG. 2B, a bottom part of the powder receiving portion 35 is curved, and the bottom part thereof is configured to receive a residual toner remaining on the photoconductor 10 during cleaning the photoconductor 10.

As shown in FIGS. 2A and 2B, the conveying screw 32 includes a rotation axis portion 36 and a blade portion 37, and further includes a conveying screw curved portion 39, which is curved along the curved portion 34 of the powder conveying path 33.

The rotation axis portion 36, which is a columnar shape, is disposed together with the blade portion 37 in the inner part of the powder conveying path 33 including the curved portion 34. Thus, the rotation axis portion 36 has flexibility, and is curved in the conveying screw curved portion 39.

The blade portion 37, which is a spiral blade, is formed on the outer periphery of the rotation axis portion 36, and is rotated in synchronization with rotation of the rotation axis portion 36, followed by conveying the powder in a prescribed direction. Moreover, the blade portion 37 is disposed together with the rotation axis portion 36 in the inner part of the powder conveying path 33. Thus, the blade portion 37 has flexibility and is curved in the conveying screw curved portion 39.

In addition, as other members, a gear 38 is disposed at one end of the conveying screw 32. This gear 38 is configured to transfer driving power from a driving source (not illustrated) via another gear, and thus the conveying screw 32 is rotated.

The conveying screw 32 includes a slipping layer on the blade portion 37 of the conveying screw curved portion 39 along the curved portion 34 of the powder conveying path 33. The slipping layer is formed in order to smoothly rotate the conveying screw 32 in the powder conveying path 33. That is, when the conveying screw 32 is left to stand for a long time under the specific condition in the powder conveying path 33, a peculiarity occurs in the rotation axis portion 36 and the blade portion 37 of the conveying screw 32 along the curved portion 34 of the powder conveying path 33. Thus, when the powder conveying device 70 is driven, the conveying screw curved portion 39 is rotated in a state that it has a shape of the curved portion 34. At that time, the rotation axis portion 36, the blade portion 37, or both thereof is collided with an inner wall of the curved portion 34 of the powder conveying path 33, and thus the entire operation of the conveying screw 32 is inhibited. In addition, an abnormal noise and an abrupt vibration are caused in the part of collision. In a powder conveying device 70 of the present invention, however, the slipping layer is formed on the surface of at least the blade portion 37 of the conveying screw curved portion 39. Thus, when a peculiarity occurs on the rotation axis portion 36 and the blade portion 37 of the conveying screw 32, the blade portion 37 can be smoothly rotated, even if it collides with an inner wall of the curved portion 34 of the powder conveying path 33, which can be prevented from the abnormal sound and the abrupt vibration, during collision.

(Process Cartridge)

Figure 3:
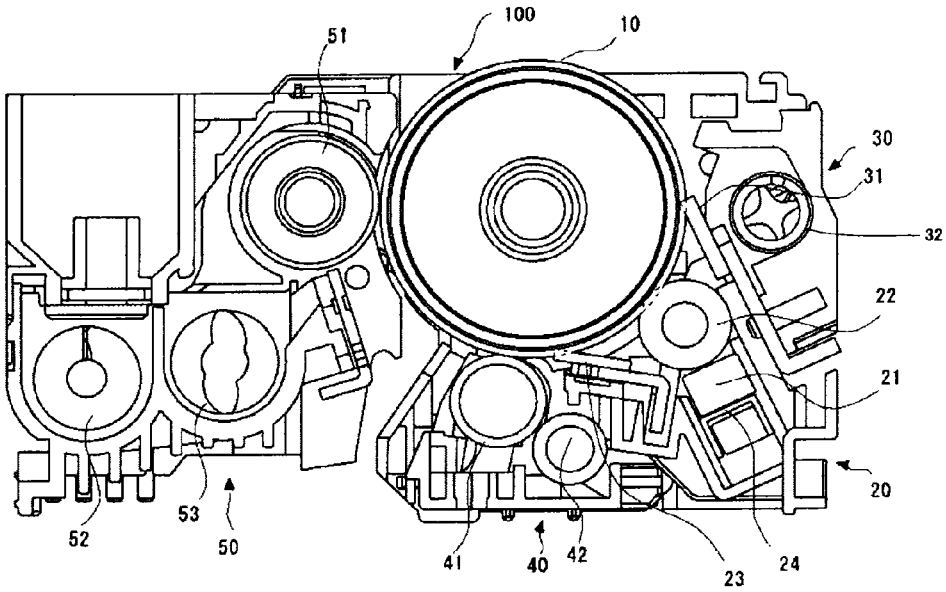
FIG. 3 is a schematic cross-sectional view of one example of a process cartridge of the present invention.

Next, a process cartridge of the present invention will be explained with reference to FIG. 3. FIG. 3 is a schematic cross-sectional view of one example of a process cartridge of the present invention.

In FIG. 3, a process cartridge 100 includes a photoconductor 10, and a lubricant coating device 20 configured to dispose to the photoconductor 10; and further includes a cleaning device 30, a charging device 40, and a developing device 50.

The cleaning device 30 includes a cleaning blade 31 configured to abut on the surface of the photoconductor 10. Near the cleaning blade 31, a conveying screw 32 is disposed in order to convey a residual toner which remains on a surface of the photoconductor 10, and is cleaned by the cleaning device 30.

The cleaning blade 31 is configured to clean the residual toner remaining on the surface of the photoconductor 10, and the aforementioned residual toner is collected and is conveyed by the conveying screw 32.

The conveying screw 32 is formed by integrating the rotation axis portion 36 with the blade portion 37 configured to convey the residual toner; and is connected to a gear configured to drive the conveying screw 32 at an end part thereof (not illustrated) in order to be rotated.

As the material of the conveying screw 32, the conveying screw 32 is formed of a flexible elastomer resin, is configured to follow a shape of the curved powder conveying path 33, and is configured to convey the residual toner in a state that it is curved, in the path.

The lubricant coating device 20 includes a solid lubricant 21, a lubricant supporting member 24 configured to support the solid lubricant 21, a lubricant coating brush roller 22 configured to rotate in contact with both of the solid lubricant 21 and the photoconductor 10, and a lubricant coating blade 23.

The lubricant coating brush roller 22 is rotated by receiving driving power which transferred from a drive transferring unit (not illustrated) via a gear disposed at an end part of the photoconductor 10, by the gear disposed at one end of the lubricant coating brush roller 22 (not illustrated); and a powdery lubricant obtained by scraping the solid lubricant 21 is coated on the surface of the photoconductor 10.

The lubricant coating blade 23 is configured to make the lubricant coated on the surface of the photoconductor 10 uniform, to thereby make a thickness of the lubricant uniform.

A charging device 40 includes a charging roller 41 disposed so as to abut on the photoconductor 10, and a charging roller cleaner 42 configured to abut on the charging roller 41 to rotate.

The charging roller 41 is configured to charge the surface of the photoconductor 10 in a uniform manner, and the charging roller cleaner 42 is configured to clean the surface of the charging roller 41.

A developing device 50 includes a developing roller 51 configured to supply a toner serving as a developer on the surface of the photoconductor 10, to thereby visualize an electrostatic latent image; a mixing roller 52 configured to stir a developer housed in a developer accommodating unit; and a supplying roller 53 configured to supply the stirred and mixed developer to the developing roller 51.

(Image Forming Apparatus)

Figure 4:
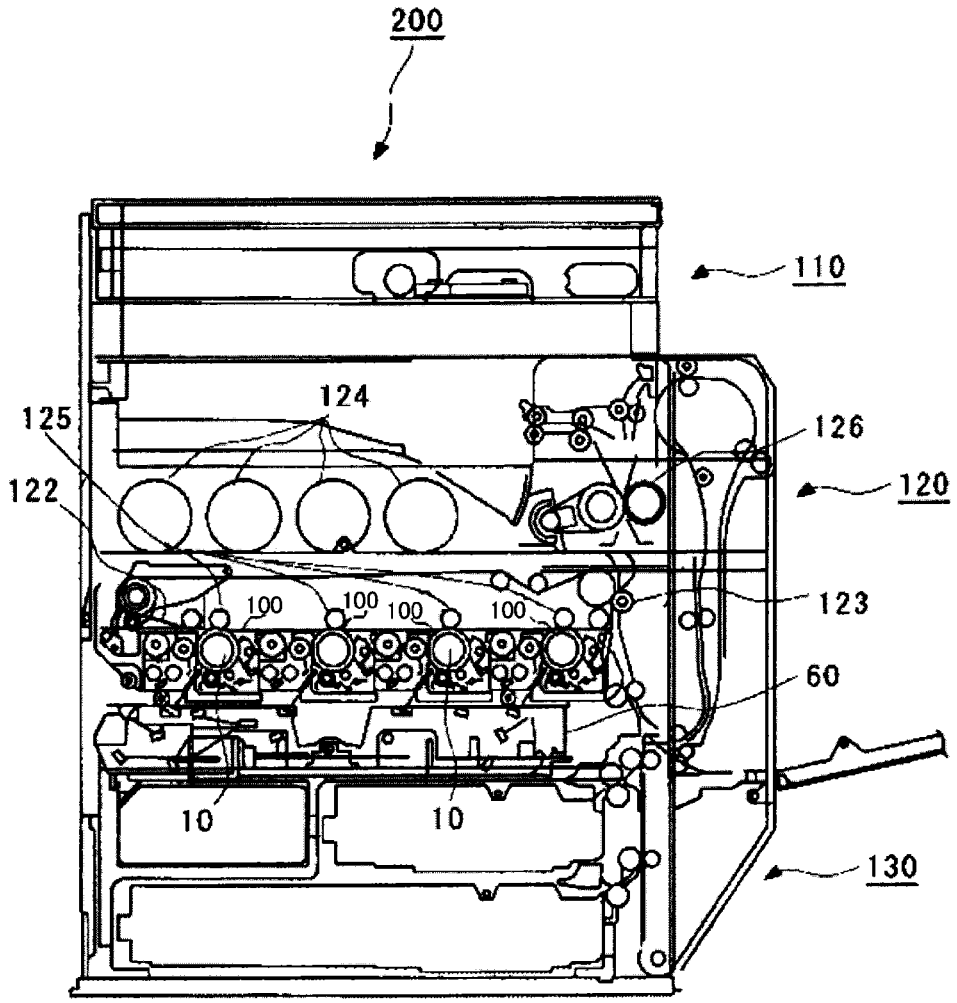
FIG. 4 is a schematic block diagram of one example of an image forming apparatus according to the present invention.

Next, an image forming apparatus according to the present invention will be explained with reference to the figure. FIG. 4 is a schematic block diagram of one example of an image forming apparatus according to the present invention.

An image forming apparatus 200 is an image forming apparatus forming a full color image, and includes a reading part 110, an image forming part 120, and a paper feeding part 130.

The image forming part 120 is provided with four process cartridges 100 (Y, C, M, K), an intermediate transfer belt 122 which is an endless belt, a secondary transfer roller 123, and toner bottles 124 for each color supplying a toner to each of the process cartridges.

The intermediate transfer belt 122 is disposed above each of the photoconductors which is an image bearer, and the lower traveling side of this intermediate transfer belt 122 is abutted on a peripheral surface of each of the photoconductors 10. The intermediate transfer belt 122 functions serving as a transfer material, and is configured to receive toner images which is formed on the surface of each of the photoconductors 10 and has mutually different colors, on top of one another. A primary transfer roller 125 is disposed facing the photoconductor 10 via the intermediate transfer belt 122.

A configuration where a toner image on each of the photoconductors 10 is formed and the toner image is transferred onto the intermediate transfer belt 122, is substantially identical in each of the process cartridges except that a toner image for each color is different.

An optical writing device 60 is disposed below a row of the process cartridges, and is configured to irradiate a charged image bearing surface with laser light based on the image information, to thereby form an electrostatic latent image.

A paper feeding part 130 is provided with a paper feeding cassette which accommodates a transfer paper serving as a recording medium. The paper feeding cassette is configured to feed a transfer paper to a nip part between the intermediate transfer belt 122 and the secondary transfer roller 123 disposed facing the intermediate transfer belt 122 in a prescribed timing.

Here, operation of the image forming apparatus will be explained hereinafter.

First, the photoconductor 10 included in the process cartridge is driven to rotate in a clockwise direction in FIG. 3. Then, by the charging roller 41 of the charging device 40 to which charging voltage has been applied, the surface of the photoconductor 10 is charged in a prescribed polar manner.

The charged photoconductor 10 is irradiated with, for example, a laser beam which exits from the optical writing device 60 in FIG. 4 and is optically modulated, to thereby form an electrostatic latent image on the surface of each of the photoconductors 10. Each of the developers is supplied from the developing roller 51 of the developing device 50 to each of the electrostatic latent images, and a toner image for each developer is formed, to thereby visualize the toner image.

Next, a transfer voltage is applied to the primary transfer roller 125, and each of the toner images on the photoconductor 10 is primarily transferred onto the rotating intermediate transfer belt 122, to thereby form a color image serving as a composite image. The color image, which is primarily transferred onto the intermediate transfer belt 122, is ejected from the paper feeding cassette of the paper feeding part 130 in a prescribed timing, to thereby secondarily transfer the image to a recording paper fed between the intermediate transfer belt 122 and the secondary transfer roller 123.

The recording paper to which the color image is secondarily transferred, is fed to a fixing device 126 located downstream, to thereby fix the color image on the recording paper by action of heat and force.

Next, the color image is fixed on the recording paper, and the resultant recording paper is ejected to a paper ejection part disposed above the body of the image forming apparatus 200 by a pair of a paper ejection roller.

Meanwhile, the toner image is transferred, and then a residual toner remaining on the photoconductor 10 is collected and removed by the cleaning blade 31 of the cleaning device 30, illustrated in FIG. 3.

As mentioned above, the removed toner for each color is collected in the powder conveying path 33 illustrated in FIG. 1, for example, and is gathered in a waste toner accommodating tank (not illustrated).

EXAMPLES

The present invention will be described with reference to the following Example. However, it should be noted that the present invention is not limited to these Examples.

Example 1

A powder conveying device, as shown in FIGS. 1, 2A, and 2B, was incorporated into a process cartridge, as shown in FIG. 3.

As a shape of the powder conveying path, a cylindrical body having an internal diameter of 6.4 mm and a length of about 470 mm was employed. As a material of the powder conveying path, PC-ABS was employed. The powder conveying path is formed so as to have one curved portion, considering that the powder conveying device was practically disposed.

A conveying screw was obtained so that a rotation axis portion and a blade portion were integrally formed using an elastomer resin. Note that, an outer diameter of the blade portion was substantially the same diameter with the internal diameter of the powder conveying path of the powder conveying device. An interval (pitch) P of the blade portion was set to 7 mm. A length thereof was substantially the same as the length of the powder conveying path, and was about 470 mm.

A slipping layer was obtained on the entire conveying screw using a siloxane compound by a dipping method.

An average thickness of the slipping layer was 5 μm.

A process cartridge including the powder conveying device, in which the conveying screw was incorporated into the powder conveying path, was left to stand under specific left-to-stand conditions, considering that it was left to stand under high temperature.

The left-to-stand conditions mean that the process cartridge was left to stand under an environment of temperature of 40° C. and humidity of 80% RH for 10 days, considering that it was stored or was transported in a warehouse or by truck at high temperature.

Comparative Example 1

A process cartridge incorporated with the powder conveying device of Example 1 was obtained in the same manner as in Example 1, except that the slipping layer was not formed in the conveying screw.

The process cartridge was left to stand in the same manner as in Example 1.

<Measurement of Sound>

A unit of each of the process cartridges is externally driven by a unit drive test device, to thereby conduct measurements of sound.

Note that, the measurements of sound were performed using an acoustic measuring device (acoustic analysis system PEQ V, product of HEAD acoustics).

Figure 5:
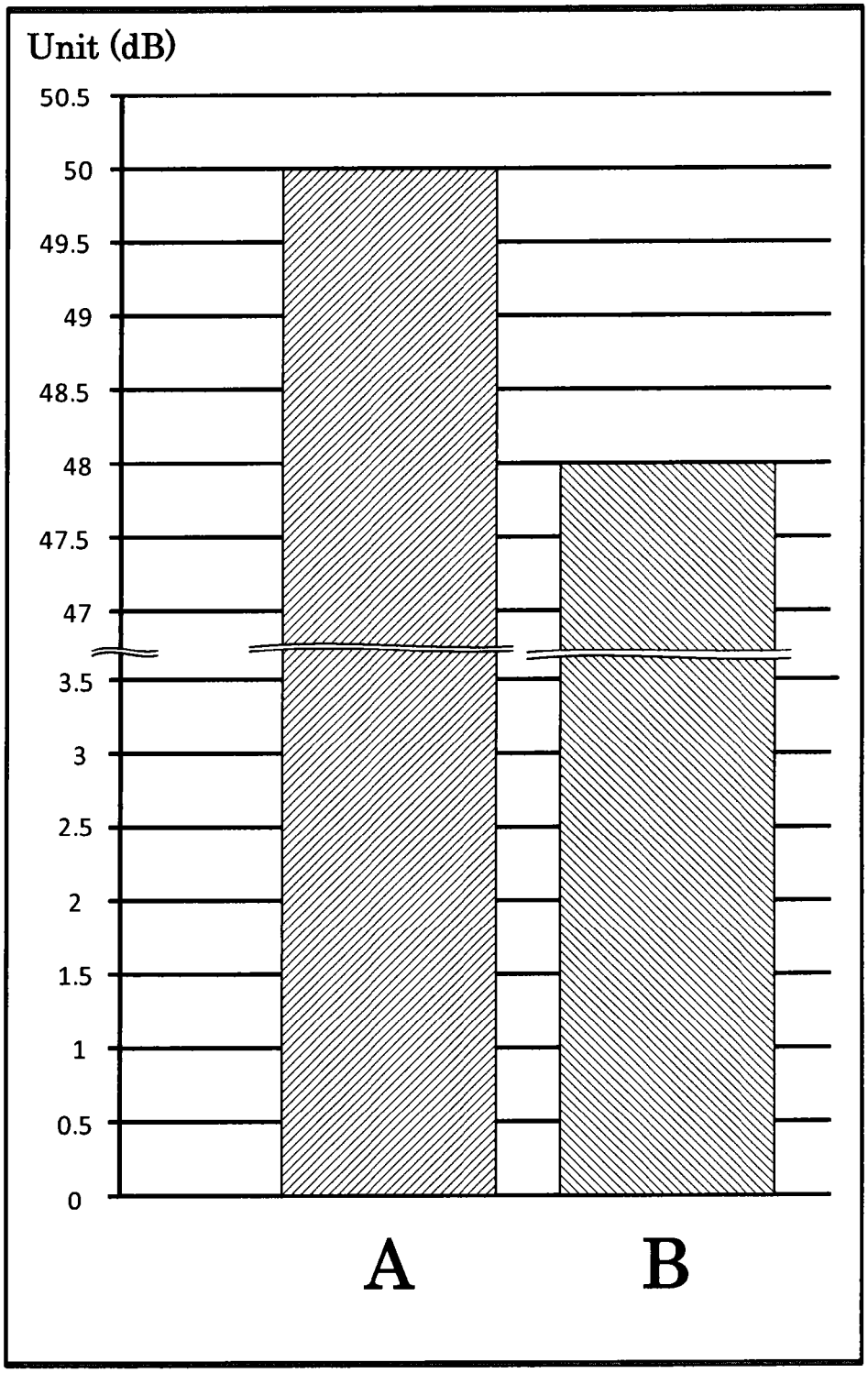
FIG. 5 shows measurement results of the sound power levels by leaving the following two process cartridges to stand for evaluation: a process cartridge including a powder conveying device incorporated with a conveying screw which has no slipping layer; and a process cartridge including a powder conveying device incorporated with a conveying screw which includes a slipping layer, where the slipping layer includes a silicon-containing compound.

Measurement results are shown in FIG. 5. In FIG. 5, "A" means a result of using a conveying screw including no slipping layer, and "B" means a result of using conveying screw including slipping layer which contains a silicon compound.

As shown in FIG. 5, the sound power level of the process cartridge of Comparative Example 1 was 50 dB, while the sound power level of the process cartridge of Example 1 was 48 dB. In other words, it is confirmed that the sound power level of Example 1 was lower by 2 dB than the sound power level of Comparative Example 1. A difference of 2 dB means that loudness of the process cartridge of Comparative Example 1 was louder by about 1.6 times compared with the loudness of the process cartridge of Example 1, when each of the process cartridges was driven. Thus, the process cartridge of Example 1 sufficiently was able to lower the sound, compared with the process cartridge of Comparative Example 1.

That is, the process cartridge of Example 1, which includes the powder conveying device incorporated with the conveying screw that includes the slipping layer containing a silicon-containing compound, can be rotated in a smooth manner; and collision between the conveying screw and the inner wall of the powder conveying path, and thus-generated vibration are not caused, even if a peculiarity occurs in the curved portion of the conveying screw. As a result, the sound power level of Example 1 is lowered therein. In addition, the banding caused by the vibration is not caused, and thus formation of an abnormal image can be prevented.

As above, according to the present invention, a powder conveying device in which a conveying screw including a slipping layer can be smoothly moved, can be smoothly moved, even if it is left to stand under high temperature for a long time and a peculiarity occurs in the conveying screw itself. As a result, rotation of the conveying screw in the powder conveying path is not inhibited, and rotary malfunction can be prevented.

Embodiments of the present invention are as follows.

<1> A powder conveying device, including:

a powder conveying path including a curved portion; and a conveying screw, wherein the conveying screw is disposed in the powder conveying path, and includes: a rotation axis portion having flexibility; and a blade portion, where the blade portion is helically formed on an outer periphery of the rotation axis portion, and is configured to convey a powder, wherein the conveying screw includes a conveying screw curved portion located in the curved portion of the powder conveying path, and wherein at least a surface of the blade portion of the conveying screw curved portion includes a slipping layer containing a silicon-containing compound.

<2> The powder conveying device according to <1>, wherein the silicon-containing compound includes at least one compound selected from a siloxane compound and a silazane compound.

<3> The powder conveying device according to any one of <1> to <2>, wherein an average thickness of the slipping layer is 2 μm to 30 μm.

<4> The powder conveying device according to any one of <1> to <3>, wherein the powder conveying device includes the slipping layer on an entire surface of the conveying screw.

<5> The powder conveying device according to any one of <1> to <4>, wherein the powder is a toner.

<6> The powder conveying device according to <5>, wherein the powder conveying path is a conveying path conveying a used toner.

<7> The powder conveying device according to <5>, wherein the powder conveying path is a conveying path conveying an unused toner.

<8> A process cartridge, including:

an image bearer;

a developing unit configured to develop an electrostatic latent image formed on the image bearer with a toner to form a toner image;

a cleaning unit configured to remove a residual toner of the toner which remains on a surface of the image bearer from which the toner image has been transferred on a recording medium; and the powder conveying device according to any one of <5> to <6>, configured to convey the residual toner removed by the cleaning unit to a toner collecting unit.

<9> An image forming apparatus, including:

the process cartridge according to <8>.

This application claims priority to Japanese application No. 2014-109254, filed on May 27, 2014 and incorporated herein by reference.

What is claimed is:

1. A powder conveying device, comprising:

a powder conveying path including a curved portion; and a conveying screw, wherein the conveying screw is disposed in the powder conveying path, and includes: a rotation axis portion having flexibility; and a blade portion, where the blade portion is helically formed on an outer periphery of the rotation axis portion, and is configured to convey a powder, wherein the conveying screw includes a conveying screw curved portion on located in the curved portion of the powder conveying path, and wherein in only a part of the conveying screw, the part including the conveying screw curved portion, at least a surface of the blade portion of the conveying screw includes a slipping layer containing a silicon-containing compound.

2. The powder conveying device according to claim 1, wherein the silicon-containing compound comprises a siloxane compound, a silazane compound, or both thereof.

3. The powder conveying device according to claim 1, wherein an average thickness of the slipping layer is 2 μm to 30 μm.

4. The powder conveying device according to claim 1, wherein the powder conveying device comprises the slipping layer on an entire surface of the conveying screw.

5. The powder conveying device according to claim 1, wherein the powder is a toner.

6. The powder conveying device according to claim 5, wherein the powder conveying path is a conveying path conveying a used toner.

7. The powder conveying device according to claim 5, wherein the powder conveying path is a conveying path conveying an unused toner.

8. The powder conveying device according to claim 1, wherein the powder conveying path is a tubular body.

9. The powder conveying device according to claim 8, wherein the tubular body is any one of a cylindrical body, an elliptically cylindrical body, a triangularly cylindrical body, and a square cylindrical body.

10. The powder conveying device according to claim 1, wherein the powder conveying path includes a powder receiving portion.

11. The powder conveying device according to claim 1, wherein the rotation axis portion has a columnar shape or a cylindrical shape.

12. The powder conveying device according to claim 1, wherein a material of the rotation axis portion is a resin.

13. The powder conveying device according to claim 12, wherein the resin is an elastomer resin.

14. The powder conveying device according to claim 1, wherein a material of the blade portion is a resin.

15. The powder conveying device according to claim 14, wherein the resin is an elastomer resin.

16. The powder conveying device according to claim 2, wherein the siloxane compound is a siloxane-based polymer or a polysiloxane-based polymer.

17. The powder conveying device according to claim 2, wherein the silazane compound is a silazane-based polymer or a polysilazane-based polymer.

18. The powder conveying device according to claim 1, wherein the powder is any one of an inorganic powder, an organic powder, a powder of metallic soap, a colored pigment, a pearl pigment, a metal powder, a tar dye, and a natural pigment.

19. A process cartridge, comprising:

an image bearer;

a developing unit configured to develop an electrostatic latent image formed on the image bearer with a toner to form a toner image;

a cleaning unit configured to remove a residual toner of the toner which remains on a surface of the image bearer from which the toner image has been transferred on a recording medium; and a powder conveying device configured to convey the residual toner removed by the cleaning unit to a toner collecting unit, wherein the powder conveying device comprises:

a powder conveying path including a curved portion; and a conveying screw, wherein the conveying screw is disposed in the powder conveying path, and includes: a rotation axis portion having flexibility and a blade portion, where the blade portion is helically formed on an outer periphery of the rotation axis portion, and is configured to convey a powder, wherein the conveying screw includes a conveying screw curved portion located in the curved portion of the powder conveying path, and wherein in only a part of the conveying screw, the part including the conveying screw curved portion, at least a surface of the blade portion of the conveying screw includes a slipping layer containing a silicon-containing compound.

20. An image forming apparatus, comprising:

a process cartridge, wherein the process cartridge comprises:

an image bearer;

a developing unit configured to develop an electrostatic latent image formed on the image bearer with a toner to form a toner image;

a cleaning unit configured to remove a residual toner of the toner which remains on a surface of the image bearer from which the toner image has been transferred on a recording medium; and a powder conveying device configured to convey the residual toner removed by the cleaning unit to a toner collecting unit, wherein the powder conveying device comprises:

a powder conveying path including a curved portion; and a conveying screw, wherein the conveying screw is disposed in the powder conveying path, and includes: a rotation axis portion having flexibility; and a blade portion, where the blade portion is helically formed on an outer periphery of the rotation axis portion, and is configured to convey a powder, wherein the conveying screw includes a conveying screw curved portion located in the curved portion of the powder conveying path, and wherein in only a part of the conveying screw, the part including the conveying screw curved portion, at least a surface of the blade portion of the conveying screw includes a slipping layer containing a silicon-containing compound.

* * * * *